US010288274B2

(12) United States Patent
Cho

(10) Patent No.: US 10,288,274 B2
(45) Date of Patent: May 14, 2019

(54) LED LIGHTING APPARATUS HAVING FLAME BARRIERS

(71) Applicants: ILSUNG CO., LTD., Chungcheongnam-do (KR); Woo Hyun Cho, Seoul (KR)

(72) Inventor: Woo Hyun Cho, Seoul (KR)

(73) Assignees: ILSUNG CO., LTD., Seoul (KR); Woo Hyun Cho, Seoul (KR)

( * ) Notice: Subject to any disclaimer, the term of this patent is extended or adjusted under 35 U.S.C. 154(b) by 61 days.

(21) Appl. No.: 15/587,500

(22) Filed: May 5, 2017

(65) Prior Publication Data

US 2018/0320875 A1 Nov. 8, 2018

(51) Int. Cl.

| | |
|---|---|
| ***F21V 17/08*** | (2006.01) |
| ***F21V 25/12*** | (2006.01) |
| ***F21V 23/02*** | (2006.01) |
| ***F21V 29/76*** | (2015.01) |
| ***F21V 7/04*** | (2006.01) |
| ***F21S 8/02*** | (2006.01) |

(52) U.S. Cl.

CPC ..... *F21V 25/12* (2013.01); *F21S 8/026* (2013.01); *F21V 7/04* (2013.01); *F21V 17/08* (2013.01); *F21V 23/02* (2013.01); *F21V 29/767* (2015.01)

(58) Field of Classification Search

None

See application file for complete search history.

(56) References Cited

U.S. PATENT DOCUMENTS

2003/0080691 A1* 5/2003 Yasuda ..... H01J 61/327 315/169.3
2014/0369031 A1* 12/2014 Livesay ..... H01L 33/642 362/147
2016/0084483 A1* 3/2016 Dubuc ..... F21V 23/023 362/373

* cited by examiner

*Primary Examiner* — Ashok Patel

(74) *Attorney, Agent, or Firm* — Sughrue Mion, PLLC

(57) ABSTRACT

Disclosed is a LED lighting apparatus comprising: a LED module including a substrate 10 having a front surface 12 and a rear surface 13, and a plurality of LEDs 11 mounted on the front surface 12 of the substrate 10 and driven by direct input of AC voltage; a heat sink 50 for dissipating heat from the LEDs 11 on the substrate 10; a plurality of capacitors 20 to eliminate flickering of the LEDs 11; a flame barrier plate 30 being made of flame-retardant material and covering the front surface 12 of the substrate 10 so as to insulate the LED module from fire flame; and a plurality of capacitor housings 31 made of flame-retardant material, each of the capacitor housings 31 including an opening 32 formed at a front side and accommodating each capacitor 20 so as to insulate the capacitor 20 therein from fire flame; a flame barrier film 40 made of flame-retardant material and covering the opening 32 of the capacitor housing 31; and lens 60 detachably coupled to the rim of the heat sink by hook 62.

10 Claims, 9 Drawing Sheets

LED LIGHTING APPARATUS HAVING FLAME BARRIERS

TECHNICAL FIELD

The present invention relates to a LED lighting apparatus, and more particularly, to a LED lighting apparatus having flame barriers.

BACKGROUND OF THE INVENTION

Recently, there are rapidly increasing demands for a LED lighting apparatus of a high power and high efficiency. According to the demands, a direct input AC powered LED lighting continues to be developed and released.

Generally, in a direct input AC powered LED lighting, a flickering of LEDs occurs due to characteristics of AC drive circuit. To reduce or eliminate the flickering of LEDs, capacitors were connected to the LED drive circuit. U.S. Pat. No. 9,532,412 discloses an example of such a direct input AC powered LED lighting system.

According to disclosure of the US patent, capacitors as anti-flickers protrude from a front surface of the substrate of LED module as the capacitors are mounted on the substrate. The protrusion of capacitors from the front surface obstructs physical contact between the rear surface of the substrate and a heat-sink, and thus it results in diminishing the efficiency of heat dissipation at the heat sink. In addition, the protrusion of capacitors from the front surface of the substrate blocks light of LEDs and thus forms a dead zone or a shading zone behind the capacitors.

Recently, it requires that a lighting device on a ceiling should comply with 'UL 5VA flammability Standard'. However, even though there were many trials to upgrade material of components, they fail to provide with substantially effective results.

SUMMARY OF THE INVENTION

It is an object of the present invention to provide a LED lighting apparatus capable of preventing from fire spreading via opening on the ceiling with a simple structure.

It is another object of the present invention is to provide a LED lighting apparatus which can meet 'UL 5VA flammability Standard' for various types of a LED light fixture.

It is also another object of the present invention is, in case that AC direct input LED lighting system includes anti-flickering component, such as a capacitor, to provide a LED lighting apparatus capable of preventing generation of shading due to anti-flicker components.

To accomplish the above-mentioned objects, the present invention comprises a LED module including a substrate having a front surface and a rear surface, and a plurality of LEDs mounted on the front surface of the substrate and driven by direct input of AC voltage; a heat sink to which the LED module is coupled for dissipating heat from the LEDs on the substrate of the LED module; a plurality of capacitors mounted on the substrate to eliminate flickering of the LEDs; a flame barrier plate being made of flame-retardant material and covering the front surface of the LED module so as to insulate the LED module from fire flame; and a plurality of capacitor flame barriers made of flame-retardant material and including a capacitor housing so as to receive and insulate the capacitor therein from fire flame.

The flame-retardant material as mentioned above may be 'UL 94-5VA rated' flame-retardant polycarbonate resin.

Each of the capacitors is displaced in the outside of beam angle of the LEDs so as not to shade beam of the LEDs. Further, each of the capacitor housings is disposed at the rear side of the substrate.

Furthermore, the capacitor housing is made integrally with the flame barrier plate.

The capacitor housings are displaced at the rear side of the substrate of the LED module, and each of the capacitor housing has an opening formed at the front side thereof. The opening is masked by a film-typed flame barrier which is made of flame-retardant material, such as 'UL 94-5VA rated' flame-retardant material.

An embodiment of the present invention comprises a LED module including a substrate having a front surface and a rear surface, and a plurality of LEDs mounted on the front surface of the substrate and driven by direct input of AC voltage; a plurality of capacitors disposed at the rear side of the substrate of the LED module in a lying position and connected to the LEDs to eliminate flickering of the LEDs; a heat sink detachably installed on a ceiling panel, including a base plate and a heat dissipating annular rim, wherein the heat dissipating annular rim is extended outwardly and circumferentially from the base plate, and wherein the base plate is attached to the LED module so as to dissipate heat from the LEDs; a flame barrier plate made of UL 94-5VA rated flame-retardant polycarbonate resin and covering the front surface of the substrate of the LED module so as to insulate the LED module from fire flame; a plurality of capacitor housings made of UL 94-5VA rated flame-retardant polycarbonate resin, wherein each of the capacitor housings has an opening formed at a front side and accommodates each capacitor so as to insulate the capacitor therein from fire flame; a film-typed flame barrier made of flame-retardant material and covering the opening of the capacitor housing; and a lens detachably coupled to the rim of the heat sink.

The base plate may include a plurality of through holes. This allows a rear portion of the capacitor housing to pass though so that it would not obstruct contact between the base plate and the rear surface of the substrate.

An another embodiment of the present invention comprises a LED module including a substrate having a front surface and a rear surface, and a plurality of LEDs mounted on the front surface of the substrate and driven by direct input of AC voltage; a plurality of capacitors disposed at the rear side of the substrate in an upright position, and the capacitors being connected to the LEDs so as to eliminate flickering of the LEDs; a heat sink including a base plate detachably coupled to the LED module to absorb heat from the LEDs on the substrate and a plurality of fins upright extended from the base plate to dissipate heat from the base plate; a flame barrier plate covering the front surface of the substrate of the LED module to insulate the LED module from fire flame and being made of UL 94-5VA rated flame-retardant polycarbonate resin, and having a central hole to allow the light beam of the LEDs to pass therethrough; a plurality of capacitor housings made of UL 94-5VA rated flame-retardant polycarbonate resin to enclose the capacitors, wherein each of the capacitor housings comprises a first wall extended upwardly from one side of the flame barrier plate and a second wall detachably coupled to the first wall; a reflector detachably coupled to a bottom surface of the heat sink plate to guide the light beam of the LEDs; and a can (housing) installed into a mounting hole of a ceiling panel.

The fins of the heat sink may make a room for receiving the capacitors between two central fins facing each other.

BRIEF DESCRIPTION OF THE DRAWINGS

These and other features, aspects, and advantages of the present invention will become better understood with reference to the following description, appended claims, and accompanying drawings:

DETAILED DESCRIPTION OF THE INVENTION

Hereinafter, preferred embodiments of the present invention will now be described in detail with reference to the accompanying drawings.

FIGS. 1 to 7 show a LED lighting apparatus according to a first embodiment of the present invention, such as a flush-mounting LED lighting apparatus.

Figure 1:
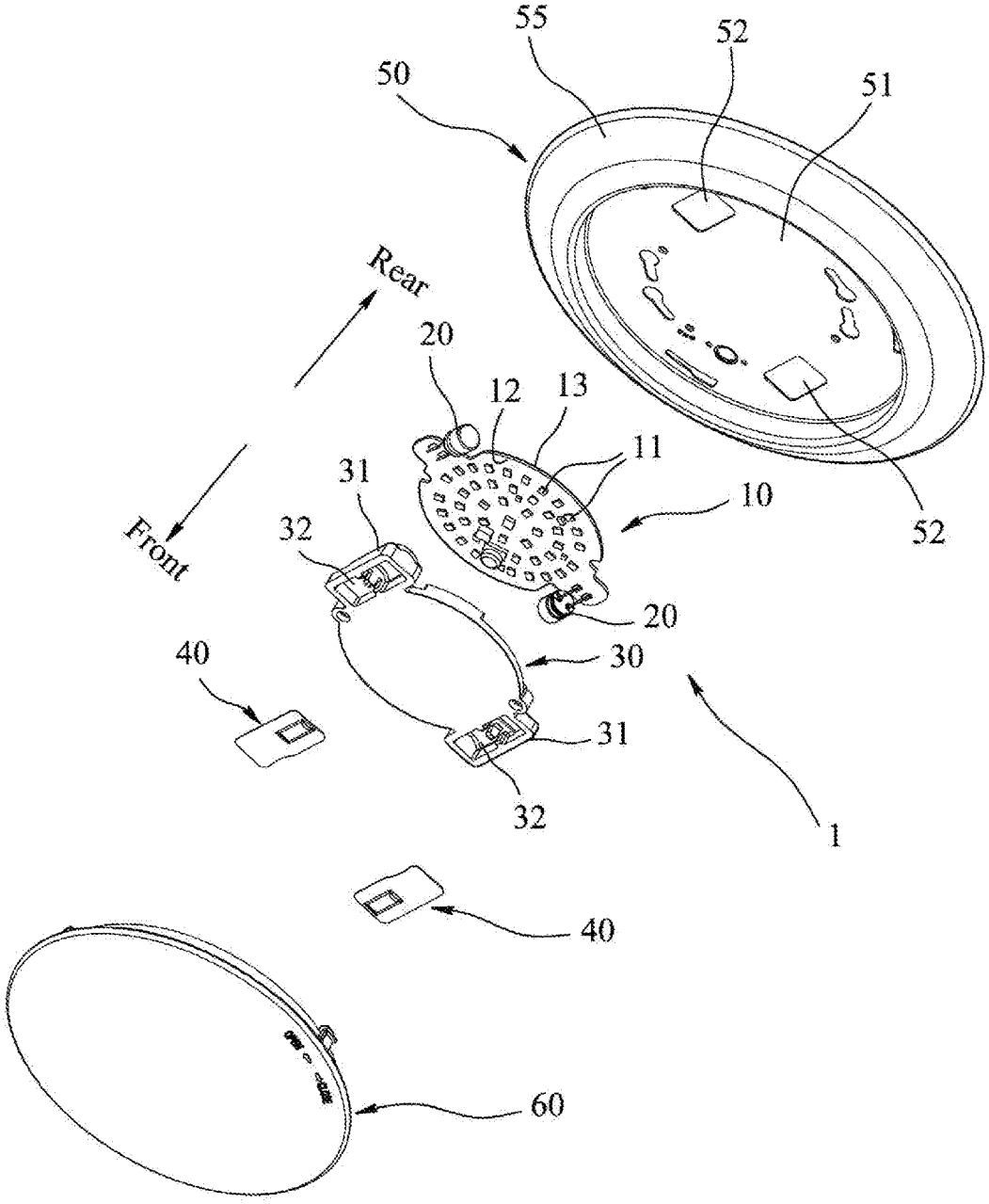
FIG. 1 shows an exploded and perspective view of a LED lighting apparatus according to a first embodiment of the present invention.
Figure 2:
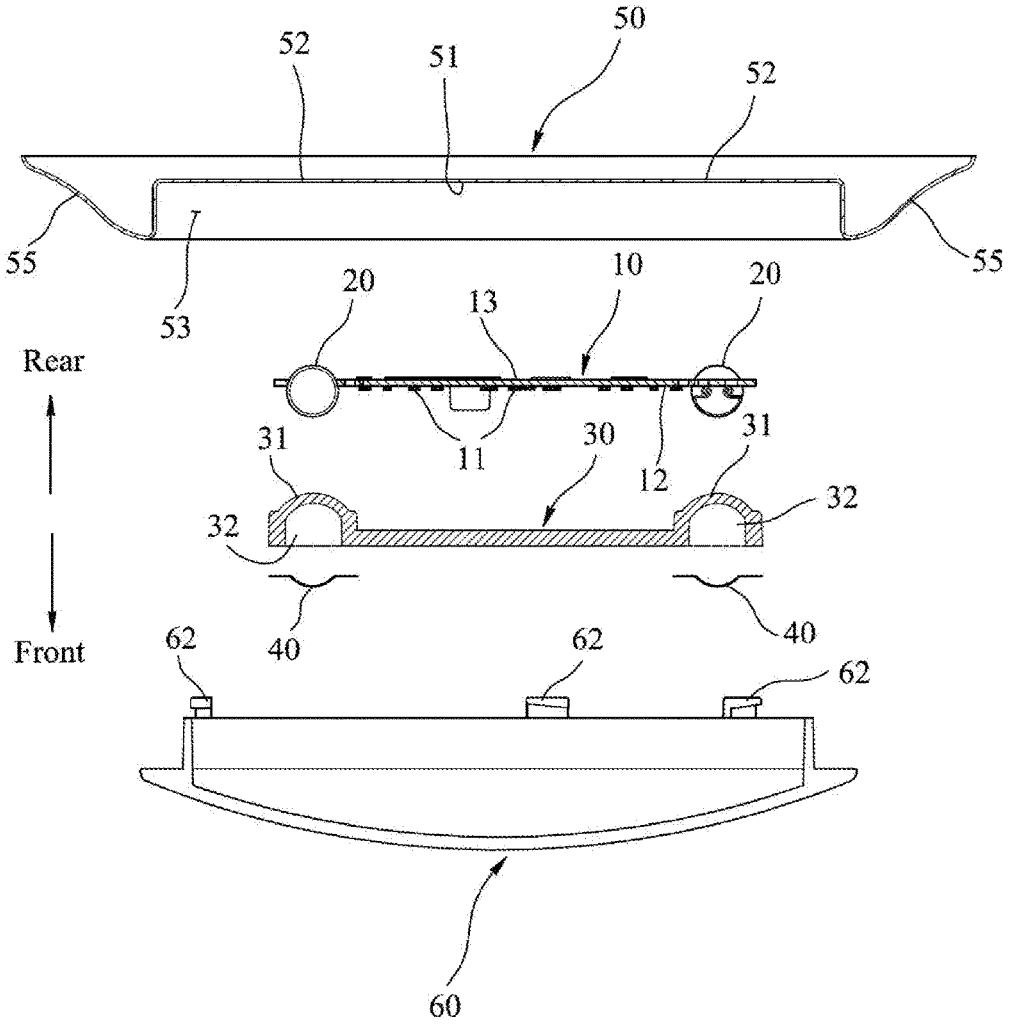
FIG. 2 shows an exploded and sectional view of a LED lighting apparatus according to the first embodiment of the present invention.
Figure 3:
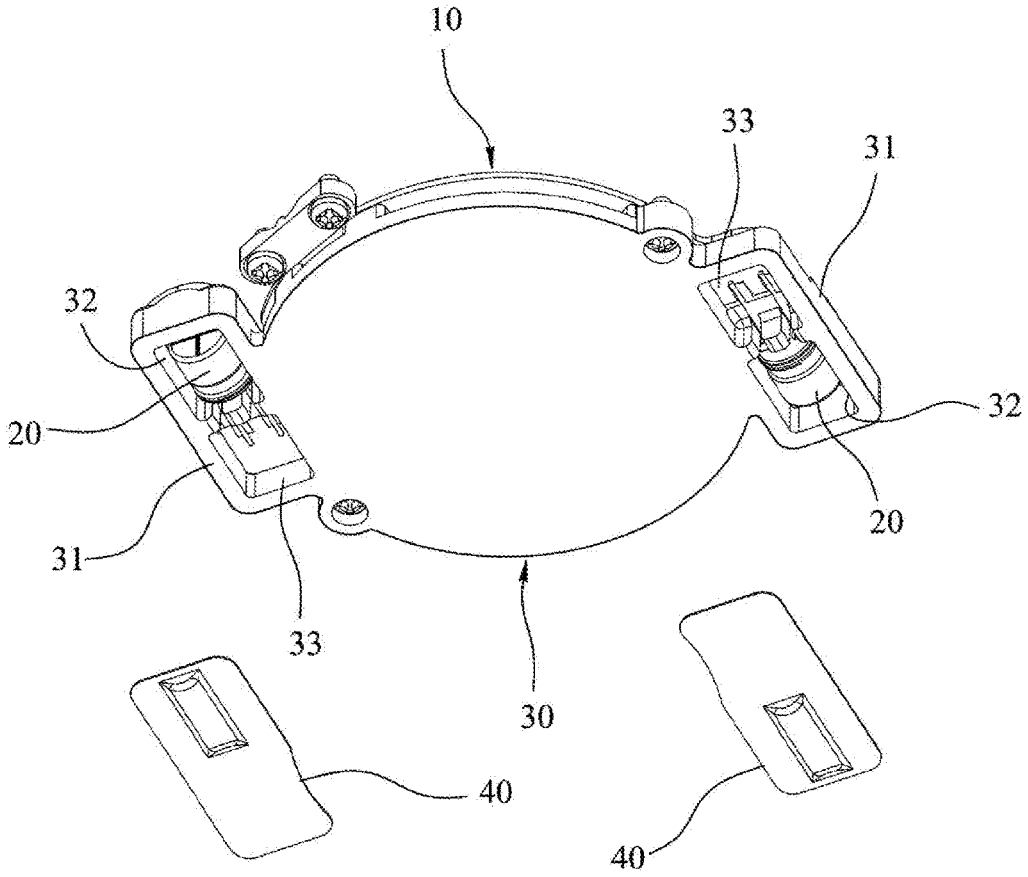
FIG. 3 shows a perspective view of subassembly of a LED module and flame barriers in the LED lighting apparatus according to the first embodiment of the present invention.

Referring to FIGS. 1 and 2, a LED lighting apparatus according to a first embodiment 1 of the present invention comprises: a LED module including a substrate 10 having a front surface 12 and a rear surface 13, and a plurality of LEDs 11 mounted on the front surface 12 of the substrate 10 and driven by direct input of AC voltage; a heat sink 50 for dissipating heat from the LEDs 11 on the substrate 10; a plurality of capacitors 20 to eliminate flickering of the LEDs 11; a flame barrier plate 30 being made of flame-retardant material and covering the front surface 12 of the substrate 10 so as to insulate the LED module from fire flame; and a plurality of capacitor housings 31 made of flame-retardant material, each of the capacitor housings 31 including an opening 32 formed at a front side and accommodating each capacitor 20 so as to insulate the capacitor 20 therein from fire flame; a film-typed flame barrier 40 made of flame-retardant material and covering the opening 32 of the capacitor housing 31; and lens 60 detachably coupled to the heat sink 50 by hooks 62.

Figure 4:
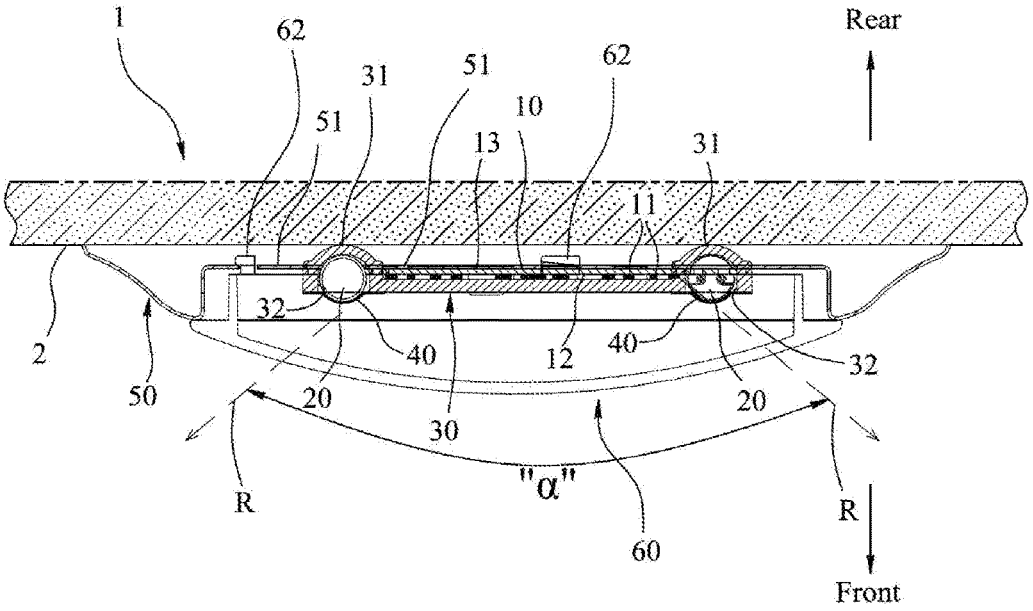
FIG. 4 shows a sectional view of the first embodiment of the present invention flush-mounted on a ceiling.
Figure 5:
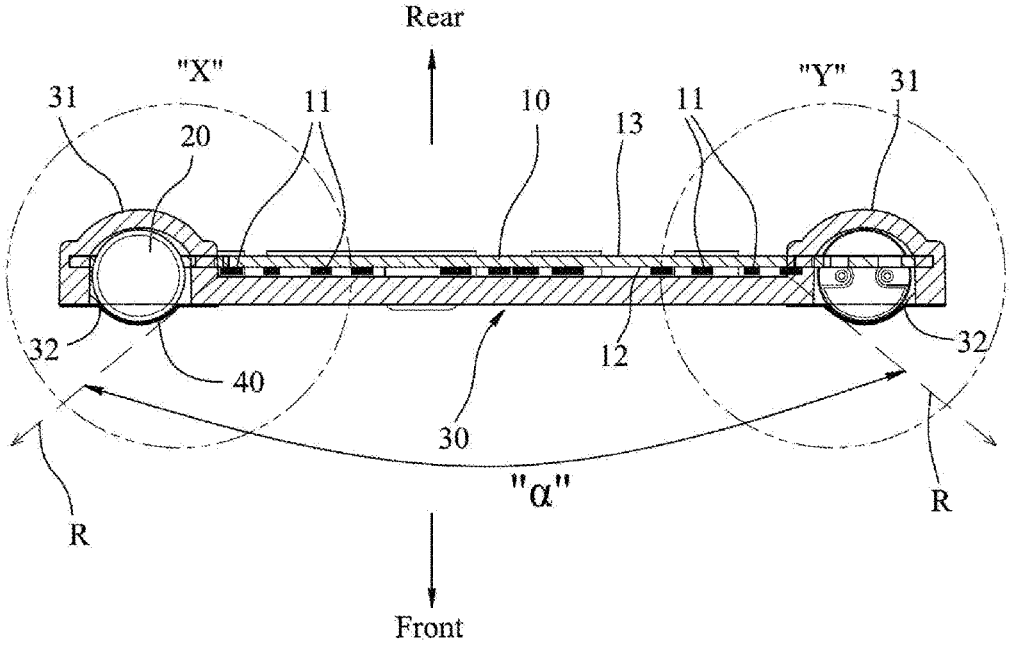
FIG. 5 shows a sectional view of the sub-assembly of a LED module and flame barriers, shown in FIG. 3.
Figure 6:
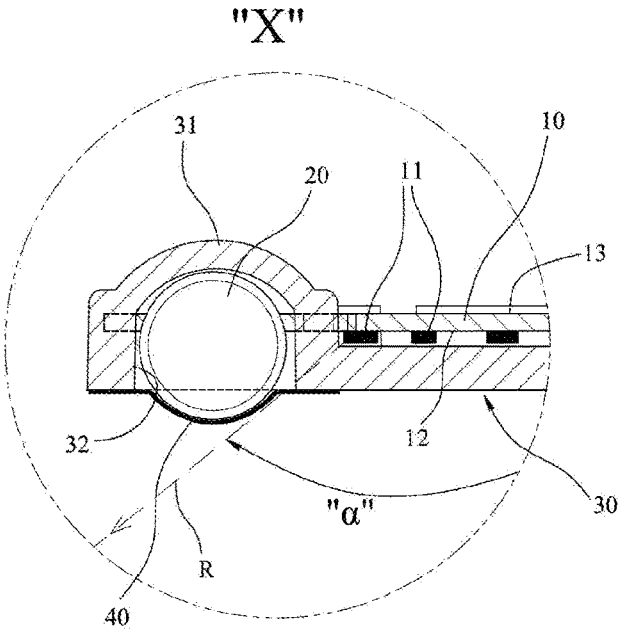
FIG. 6 shows an enlarged view of "X" part in the FIG. 5.
Figure 7:
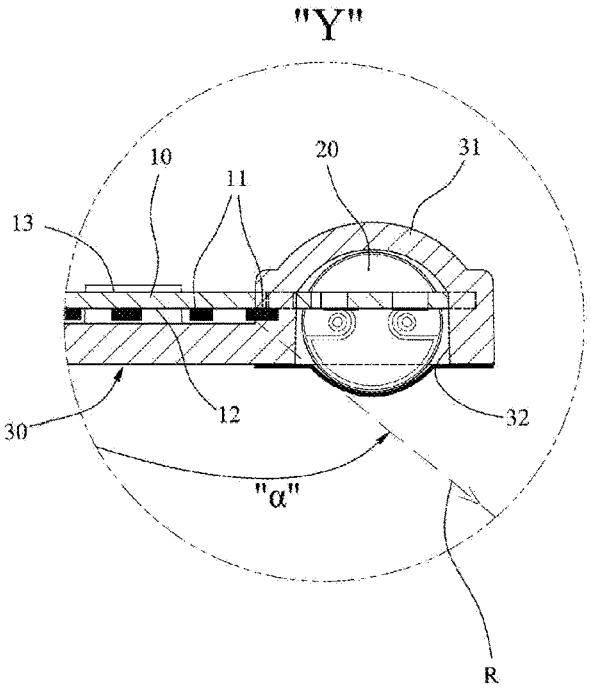
FIG. 7 shows an enlarged view of "Y" part in the FIG. 5.

As shown in FIGS. 2 and 4, the heat sink 50 includes a base plate 51 and a heat dissipating annular rim 55. The heat dissipating annular rim 55 is extended outwardly and circumferentially from the base plate 51. The base plate 51 is attached to the LED module so as to dissipate heat from the LEDs 11. The base plate 51 includes a plurality of through holes which allow a rear portion of the capacitor housing 31 to pass though so as not to obstruct contact between the base plate 51 and the rear surface 13 of the substrate 10.

As shown in FIGS. 4 to 7, the capacitors 20 are displaced in the outside of beam angle $\alpha$ of the LEDs 11. Further, the capacitors 20 are disposed at the rear side of the substrate 10. According to this structure, the capacitors 20 do not shade beam R of the LEDs 11.

The flame barrier plate 30 is made of light-transmittable and flame-retardant material, and the flame barrier plate 30 covers the front surface 12 of the substrate 10 so as to insulate the LED module from fire flame. Preferably, the material of the flame barrier plate 30 may be 'UL 94-5VA rated' flame-retardant polycarbonate resin to meet 'UL 5VA flammability Standard'. When the flame barrier plate 30 is assembled in the LED lighting apparatus 1, it can protect the LED module from fire flame and also it allows for down-lighting.

As shown in FIGS. 3 to 7, the capacitor housings 31 are displaced at the rear side of the substrate 10 of the LED module. Each of the capacitor housing 31 has an opening 32 formed at the front side thereof. The opening 32 is covered with the flame barrier film 40.

As the capacitor 20 is enclosed with the sidewall of the capacitor housing 31 and the opening 32 of the capacitor housing 31 is shield with the flame barrier film 40, the capacitor 20 is wholly covered and protected from fire flame.

Preferably, the flame barrier plate 30 and the capacitor housings 31 are formed integrally in one mould. In particular, the flame barrier plate 30 and the capacitor housings 31 are made of 'UL 94-5VA rated' flame-retardant polycarbonate resin to meet 'UL 5VA flammability Standard'.

FIGS. 8 to 12 show a LED lighting apparatus 100 according to a second embodiment of the present invention, such as a recess-mounting LED lighting apparatus.

Figure 8:
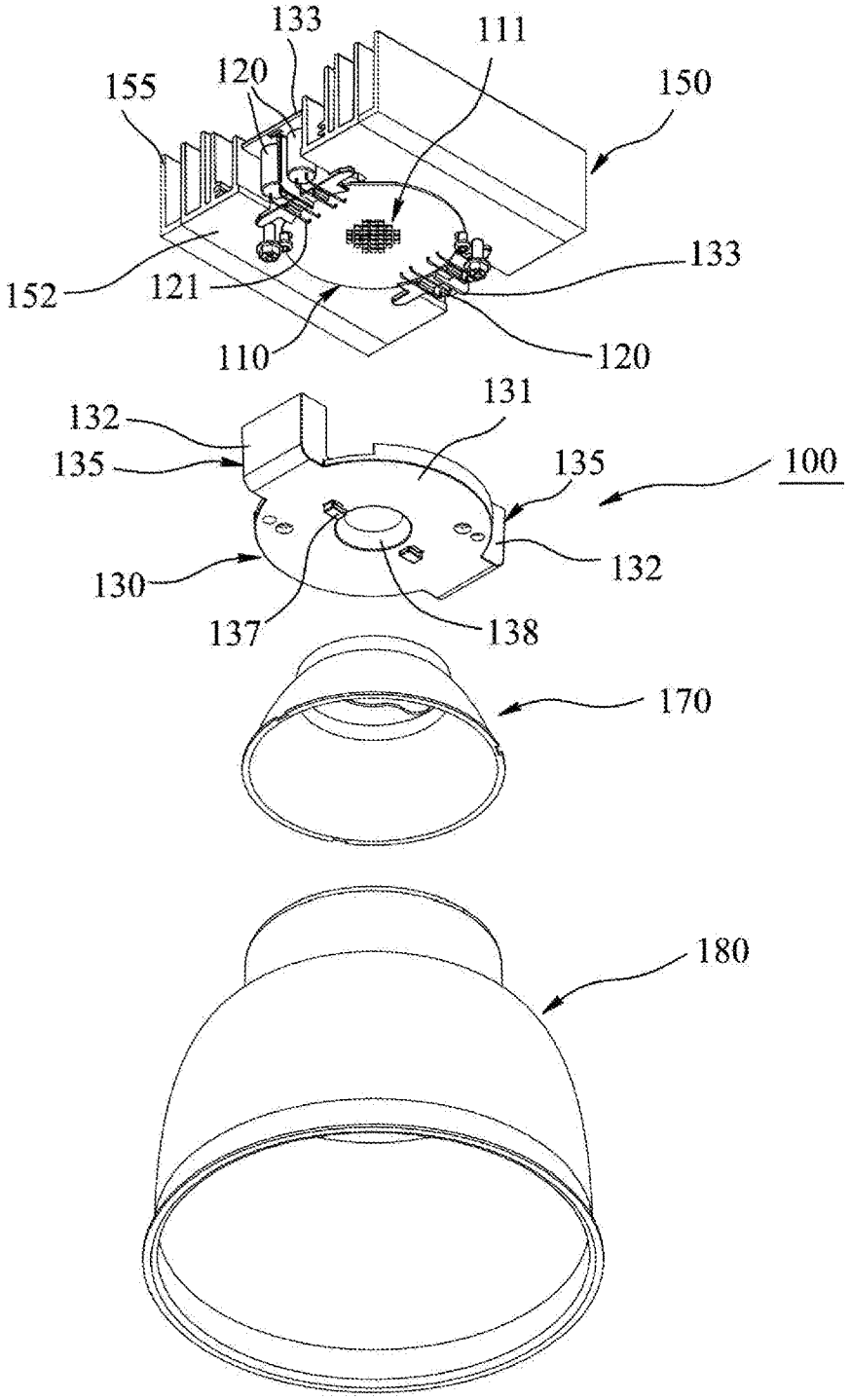
FIG. 8 shows an exploded and perspective view of a recess-mount typed LED lighting apparatus according to the second embodiment of the present invention.
Figure 9:
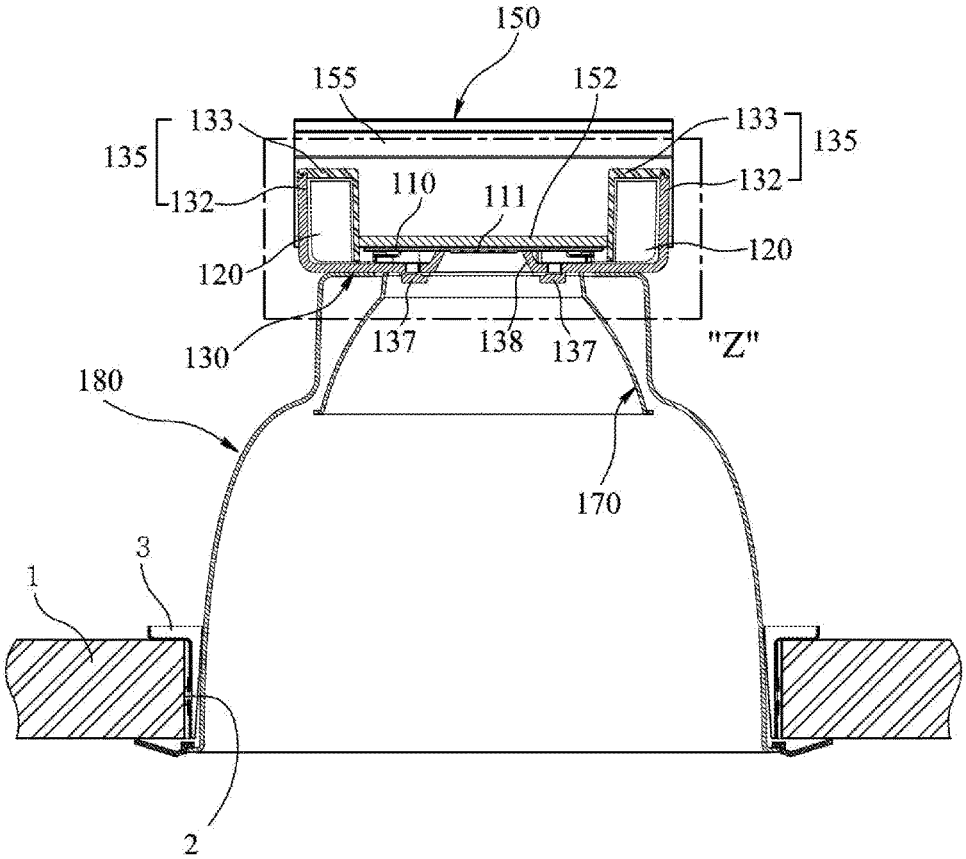
FIG. 9 shows a sectional view of the second embodiment of the present invention recess mounted on a ceiling.

Referring to FIGS. 8 and 9, a LED lighting apparatus according to a second embodiment 100 of the present invention comprises a LED module including a substrate 110 having a front surface 112 and a rear surface 113, and a plurality of LEDs 111 mounted on the front surface 112 of the substrate 110 and driven by direct input of AC voltage.

A plurality of capacitors 120 are disposed at the rear side of the substrate 110 in an upright position, and further the capacitors 120 are connected to the LEDs 111 by lead wires 121 so as to eliminate flickering of the LEDs 111.

A heat sink 150 is detachably coupled to the LED module. The heat sink 150 includes a base plate 152 being in contact with the substrate 110 to absorb heat of the LEDs 111 on the substrate 110 and a plurality of fins 155 upright extended from the base plate 152 to dissipate heat from the base plate 152.

Figure 10:
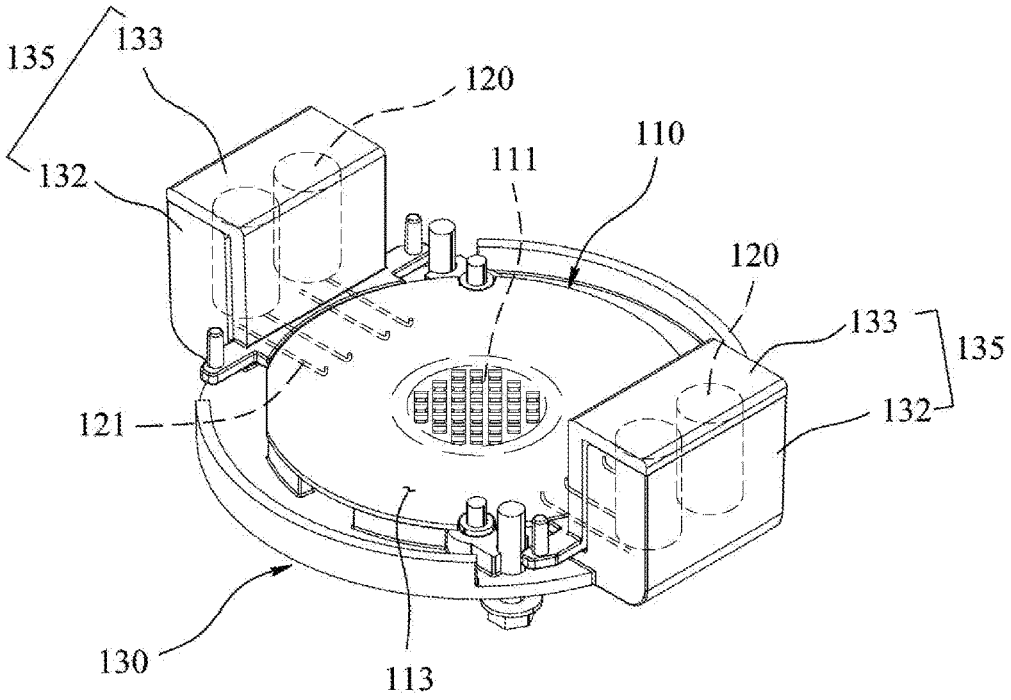
FIG. 10 shows a perspective view of subassembly of a LED module and flame barriers in the LED lighting apparatus according to the second embodiment of the present invention.
Figure 11:
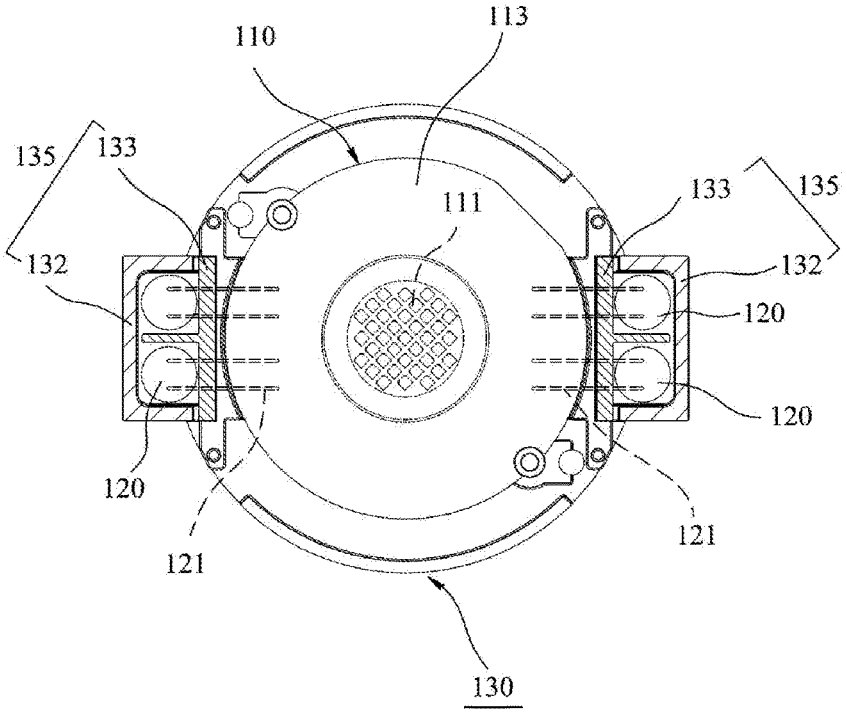
FIG. 11 shows a top view of subassembly of a LED module and flame barriers shown in FIG. 10.
Figure 12:
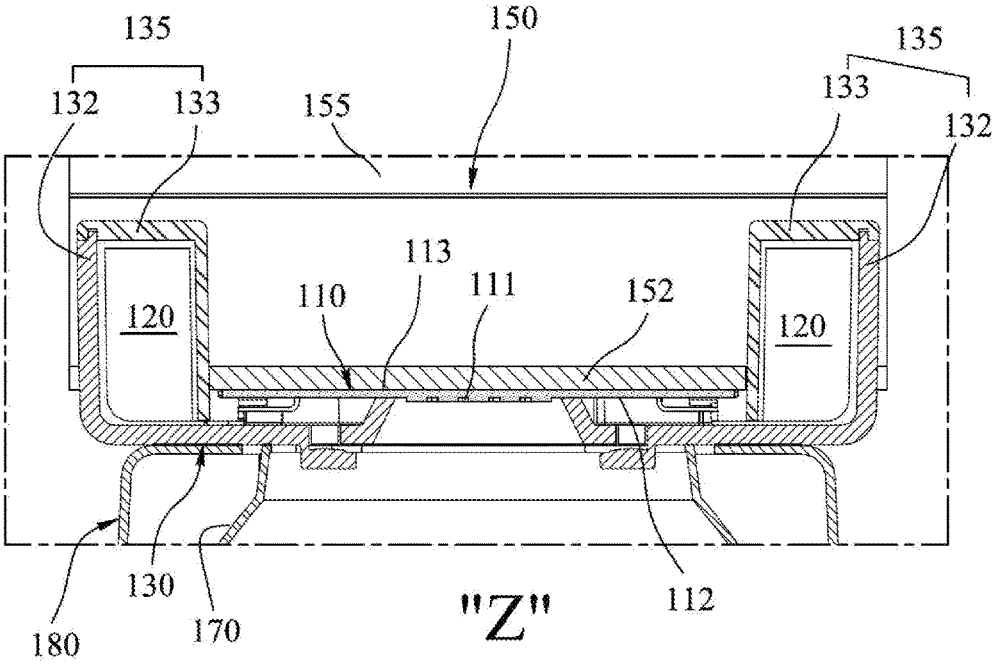
FIG. 12 shows an enlarged view of "Z" part in the FIG. 9.

As shown in FIGS. 10 to 12, a flame barrier plate 130 is coupled to the heat sink 150 and covers the front surface 112 of the substrate 110 of the LED module to insulate the LED module from fire flame. The flame barrier plate 130 is made of UL 94-5VA rated flame-retardant polycarbonate resin. The flame barrier plate 130 has a central hole 138 which allows the light beam of the LEDs 111 to pass therethrough.

There are on both sides of the flame barrier plate 130 provided a plurality of capacitor housings 135 to enclose the capacitors 120, respectively. Preferably, the capacitor housings 135 are made of UL 94-5VA rated flame-retardant polycarbonate resin so as to meet 'UL 5VA flammability Standard'.

As shown in FIGS. 10 and 11, each of the capacitor housings 135 comprises a first wall 132 extended upwardly from one side of the flame barrier plate 130 and a second wall 133 detachably coupled to the first wall 132.

As shown in FIGS. 8 and 9, the fins 155 of the heat sink 150 may make a room for receiving the capacitors 120 and the capacitor housing 135 between two central fins facing each other.

A reflector 170 is detachably coupled to a bottom 131 of the flame barrier plate 130 to guide the light beam of the LEDs. On the bottom 131, there are provided two of hooks 137 to engage with the reflector 170. A can (housing) 180 is detachably coupled to the heat sink 150 at the upper end and is installed into a mounting hole 2 of a ceiling panel 1 with bracket 3.

What is claimed is:

1. An LED lighting apparatus, comprising:

a LED module including a substrate having a front surface and a rear surface, and a plurality of LEDs mounted on the front surface of the substrate and driven by direct input of AC voltage;

a heat sink to which the LED module is coupled for dissipating heat from the LEDs on the substrate of the LED module;

a plurality of capacitors mounted on the substrate to eliminate flickering of the LEDs;

a flame barrier plate being made of flame-retardant material and covering the front surface of the substrate of the LED module so as to insulate the LED module from fire flame; and a plurality of capacitor housings made of flame-retardant material, each capacitor housing receiving the capacitor therein to insulate from fire flame.

2. The LED lighting apparatus of claim 1, wherein each of the capacitors is disposed in the outside of beam angle of the LEDs so as not to shade beam of the LEDs, and wherein each of the capacitor housings is disposed at the rear side of the substrate.

3. The LED lighting apparatus of claim 2, wherein the capacitor housings and the flame barrier plate are formed integrally in a body.

4. The LED lighting apparatus of claim 2, wherein the capacitor housings are disposed at the rear side of the substrate of the LED module, each of the capacitor housing having an opening formed at the front side thereof, and the opening being masked by a flame barrier film made of flame-retardant material.

5. The LED lighting apparatus of claim 4, wherein the base plate of the heat sink includes a plurality of holes, through which a rear portion of the capacitor housing passes.

6. The LED lighting apparatus of claim 1, wherein the flame-retardant material comprises UL 94-5VA rated flame-retardant polycarbonate resin.

7. The LED lighting apparatus of claim 1, wherein the capacitor housing comprises a first wall extended rearwards from the flame barrier plate and a second wall detachably coupled to the first wall.

8. An LED lighting apparatus, comprising:

an LED module including a substrate having a front surface and a rear surface, and a plurality of LEDs mounted on the front surface of the substrate and driven by direct input of AC voltage;

a plurality of capacitors disposed at the rear side of the substrate of the LED module in a lying position and connected to the LEDs to eliminate flickering of the LEDs;

a heat sink attached on a surface of a ceiling panel, the heat sink including a base plate and a heat dissipating annular rim, wherein the heat dissipating annular rim is extended outwardly and circumferentially from the base plate, and wherein the base plate is attached to the LED module so as to dissipate heat from the LEDs;

a flame barrier plate made of UL 94-5VA rated flame-retardant polycarbonate resin and covering the front surface of the substrate of the LED module so as to insulate the LED module from fire flame;

a plurality of capacitor housings made of UL 94-5VA rated flame-retardant polycarbonate resin, wherein each of the capacitor housings has an opening formed at a front side and accommodates each capacitor so as to insulate the capacitor therein from fire flame;

a flame barrier film made of flame-retardant material and covering the opening of the capacitor housing; and a lens detachably coupled to the rim of the heat sink, wherein the base plate includes a plurality of through holes which allow a rear portion of each capacitor housing to pass though so as not to obstruct contact between the base plate and the rear surface of the substrate.

9. An LED lighting apparatus, comprising:

an LED module including a substrate having a front surface and a rear surface, and a plurality of LEDs mounted on the front surface of the substrate and driven by direct input of AC voltage;

a plurality of capacitors disposed at the rear side of the substrate in an upright position, and the capacitors being connected to the LEDs so as to eliminate flickering of the LEDs;

a heat sink including a base plate detachable coupled to the LED module to absorb heat from the LEDs on the substrate and a plurality of fins upright extended from the base plate to dissipate heat from the base plate;

a flame barrier plate covering the front surface of the substrate of the LED module to insulate the LED module from fire flame and being made of UL 94-5VA rated flame-retardant polycarbonate resin, and having a central hole to allow the light beam of the LEDs to pass therethrough;

a plurality of capacitor housings made of UL 94-5VA rated flame-retardant polycarbonate resin to enclose the capacitors, wherein each of the capacitor housings comprises a first wall extended upwardly from one side of the flame barrier plate and a second wall detachably coupled to the first wall;

a reflector detachably coupled to a bottom surface of the heat sink to guide the light beam of the LEDs; and a can surrounding the reflector and being installed into a mounting hole of a ceiling panel.

10. The LED lighting apparatus of claim 8, wherein the fins of the heat sink make a room for receiving the capacitors between two central fins facing each other.

* * * * *